United States Patent [19]

Brünker

[11] 4,111,354

[45] Sep. 5, 1978

[54] VALVE BAG

[75] Inventor: Dieter Brünker, Bremen, Fed. Rep. of Germany

[73] Assignee: Anker-Schiffarts-Gesellschaft mbH & Co. KG, Bremen, Fed. Rep. of Germany

[21] Appl. No.: 742,536

[22] Filed: Nov. 17, 1976

[30] Foreign Application Priority Data

Nov. 22, 1975 [DE] Fed. Rep. of Germany ..... 2552438

[51] Int. Cl.[2] ..... B65D 31/14; B65D 33/30

[52] U.S. Cl. ..... 229/62.5; 229/65

[58] Field of Search ..... 229/62.5, 65; 150/9

[56] References Cited

U.S. PATENT DOCUMENTS

| | | | |
|---|---|---|---|
| 810,318 | 1/1906 | Bates | 229/62.5 |
| 2,444,891 | 7/1948 | Johnsson | 229/62.5 |
| 2,572,686 | 10/1951 | Andre | 229/62.5 |
| 3,894,682 | 7/1975 | Harmsen | 229/62.5 |

FOREIGN PATENT DOCUMENTS

| | | | |
|---|---|---|---|
| 116,539 | 6/1946 | Sweden | 229/62.5 |
| 457,419 | 11/1936 | United Kingdom | 229/62.5 |

*Primary Examiner*—Stephen P. Garbe

*Attorney, Agent, or Firm*—Christie, Parker & Hale

[57] ABSTRACT

A valve bag for bulk materials has a filler valve inserted in an end closure section and consisting of a tube of flexible material which passes through the end closure section and a wire spring attached to the tube and bearing against the end closure section for folding over the tube to pinch off the tube and thereby close the valve automatically after the bag has been filled. Preferably, the valve bag when empty is folded so as to hold the spring in its stressed condition with the filler valve open. The spring may be shaped as an S, Z or 8.

15 Claims, 8 Drawing Figures

VALVE BAG

This invention refers to bags for bulk material, which consist of a tube of paper or other sheet material, closed at either end with a closure section formed for example by folding over and gluing end portions of the tube.

It is known to equip such bags with a filler valve inserted in one of the end or closure sections, which valve can be closed after the bag has been filled by folding over along a fold line, a wire element or the like being provided to hold the valve closed.

In the bags hitherto proposed, one part of the filler valve has to be turned over manually with respect to another part of the valve to close the valve, the wire element then fixing the positions of the parts relative to one another. It is also known to let one part of the filler valve protrude from the bag so that it can be closed by welding or folding over, and then pushed back into the bag.

In all these known bag constructions valve closure requires a manual operation. While it is known to weld closed filler valves by machine, such machines for various reasons are not very successful.

The aim of the present invention is to provide a valved bag having a filler valve which closes automatically, and a bag in accordance with the invention comprises a tubular body, closure sections closing the opposite ends of the body, and a filler valve secured in one of the closure sections, the filler valve including a tube portion extending through the one closure section, and spring means so attached to the tube portion and acting against the said one closure section that, in use of the bag, the tube portion is folded over by the spring to pinch-off the tube portion and thereby close the filler valve.

Preferably, the valve bag when empty is folded to hold the spring means in its stressed condition and the filler valve open. As a result, unintentional closure of the filler valve during storage of the valve bags is prevented.

With a valve bag of this construction, closure of the filler valve is completely automated, without the use of machines.

The spring means preferably comprises a spring element having a first end section attached to an inner end part of the filler valve tube portion, and a second, opposite end section which is free and bears against the one end section, an outer end part of the filler valve tube portion being fastened to the one closure section.

The spring element may advantageously be produced from spring wire, and preferably in an unstressed state, has a closed "8" configuration. The ends of the wire may be connected firmly together by a connector element or the like. This design of the spring element ensures that the spring wire is stressed primarily in torsion and only to a slight degree in bending. It is possible for the proportion of the bending forces to be reduced practically to the value zero. The arms of the spring element which are subjected to torsion are sufficiently long to prevent overloading or fatigue of the spring during the time of storage of the bag before filling during which time the spring is held stressed.

A better understanding of the invention will be had from the following detailed description given by way of example with reference to the accompanying drawings, in which.

Figure 1:
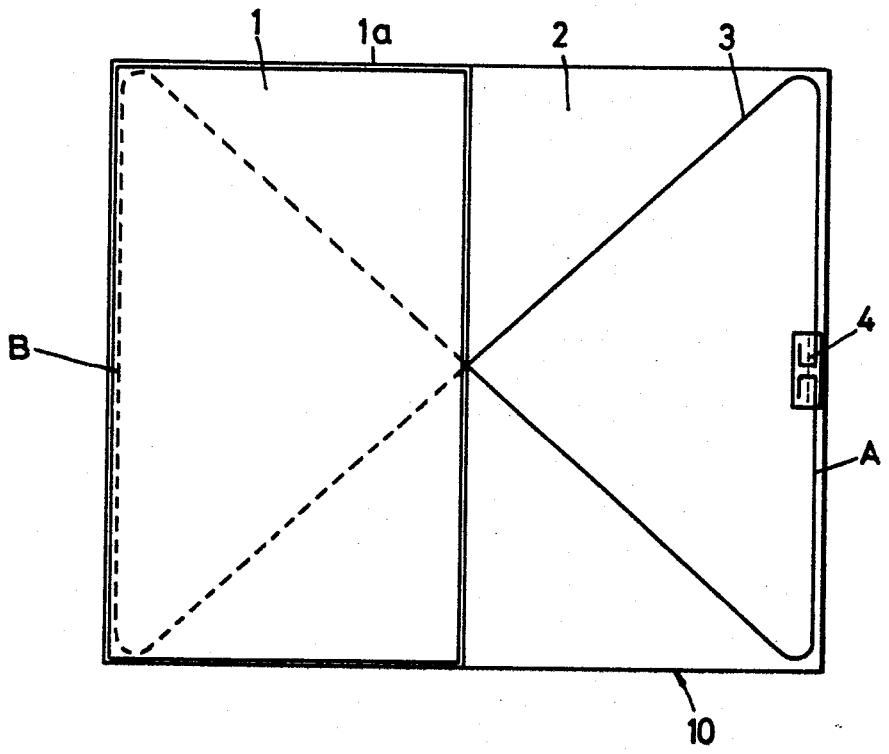
FIG. 1 is a plan view of a filler valve for a valve bag.
Figure 2:
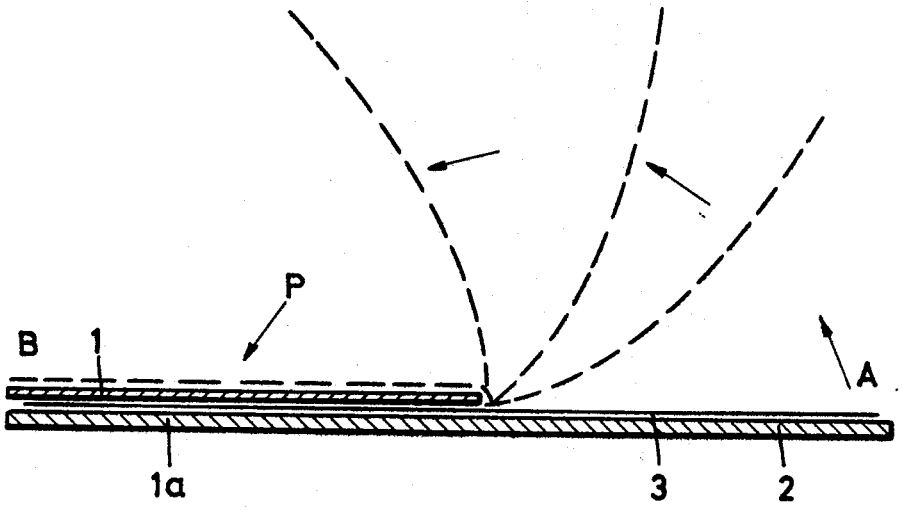
FIG. 2 is a side sectional view of the filler valve of FIG. 1.

Illustrated in FIGS. 1 and 2 is a filler valve 10 for a valve bag made of paper, plastics film, or the like, and consisting of a piece of a tube of plastics, paper or the like material, which is open at both ends (right and left as seen in the drawings) and which in a closed condition of the valve is folded over about a centre fold line which subdivides the tube transversely to the tube axis into a first part 1*a* and a second part 2.

When the two parts 1*a* and 2 of the filler valve tube are lying out flat (FIGS. 1 and 2), a spring element 3 of thin spring wire overlies the tube parts. This spring element 3 is in a closed "eight" configuration, the central arms of which cross in a "*x*" at an angle of approximately 90°. The two free ends of the spring wire are bent into U-shape and connected firmly together by means of a connection piece 4 of sheet metal.

The spring element 3 has a free end section A which includes the closure piece 4 and overlies tube part 2, and an opposite end section B which is fixed by means of a piece 1 of adhesive tape relatively firmly to the first part 1*a* of the filler valve tube. The adhesive tape 1 extends approximately up to the fold line of the filler valve 10 as shown in FIG. 1.

In FIG. 2 it is indicated by a number of arrows designated at one point by P, how the free end section A of the spring element 3 may be turned over, and thereby stressed, until it overlies the other end section B sandwiched between the adhesive tape 1 and filler valve tube part 1*a*. When the end section A of spring element 3 is turned over, the arms of the spring member 3 which cross are primarily subjected to a twisting action and thus to torsional loading, and are only bent at a very large radius. This twisting and bending at a large radius excludes any permanent deformation of the spring wire, so that even when the spring element is held in the stressed state, illustrated by broken lines in FIG. 2, for a long time, the spring element will still recover its flat condition when released.

The filler valves as described above may be produced separately from valve bags by a continuous process in which a flattened endless tube runs through a machine in which spring elements 3 are attached by their end sections B to the tube. The individual valves 10 may then either be separated immediately by severing from the endless tube or the latter may be rolled up. Stored and/or shipped ready for individual valves to be separated therefrom subsequently. The position of the separating cuts running transversely to the axis of the endless tube may be fixed conveniently by sensing the spring element 3.

Figure 3:
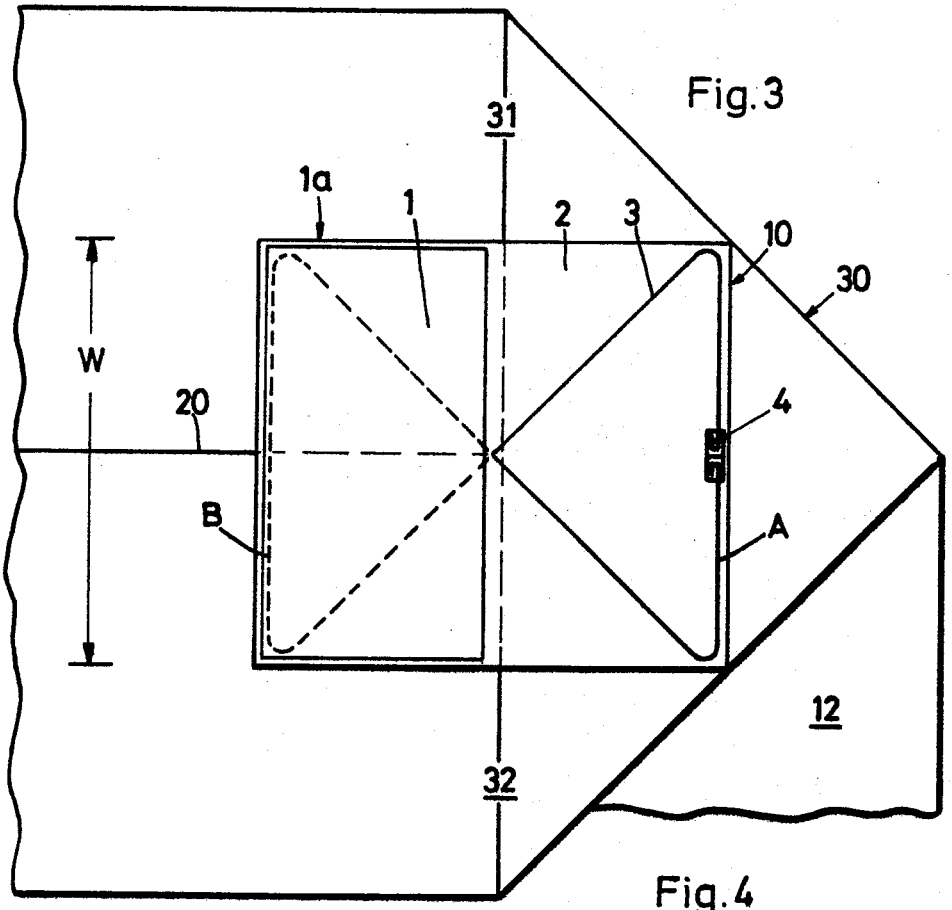
FIG. 3 is a plan view of an upper closure section of a valve bag showing the filler valve of FIG. 1 before the trapezoidal end flaps thereof are folded over.

Valve bags are usually produced in such a way that their top and bottom closure sections 30 (FIGS. 3 and 4) lie in the main plane of the valve bag when the bag is empty, to keep the space required for storing empty bags to a minimum. The main plane of valve bag 12, shown in FIGS. 3 and 4, coincides with the plane of the paper. In FIG. 3 the width W of the bag is shown after filling.

As shown in FIG. 3, to assemble the valve bag, the filler valve lying flat with the spring element 3 unstressed and having a width corresponding to the clear width W of the valve bag is, with the spring element 3 uppermost, laid upon the upper face of the closure section 30 of the valve bag 12, so that the filler valve butts against the boundary lines of the closure section 30 at the righthand side. The part 2 of the filler valve tube is glued or in some other way attached by its underside to the upper face of the closure section, as shown in FIG. 3. The free end section A of the spring element 3 is then raised, and swung over to lie on top of the fixed end section B as illustrated in FIG. 2, and free end section A is fixed in this position by folding over the trapezoidal end flaps 31 and 32 of the closure section (FIG. 4) and fastening the folded flaps 31 and 32 together such as by gluing by a piece of tape laid on top of them. Welded connections could also be employed.

Figure 4:
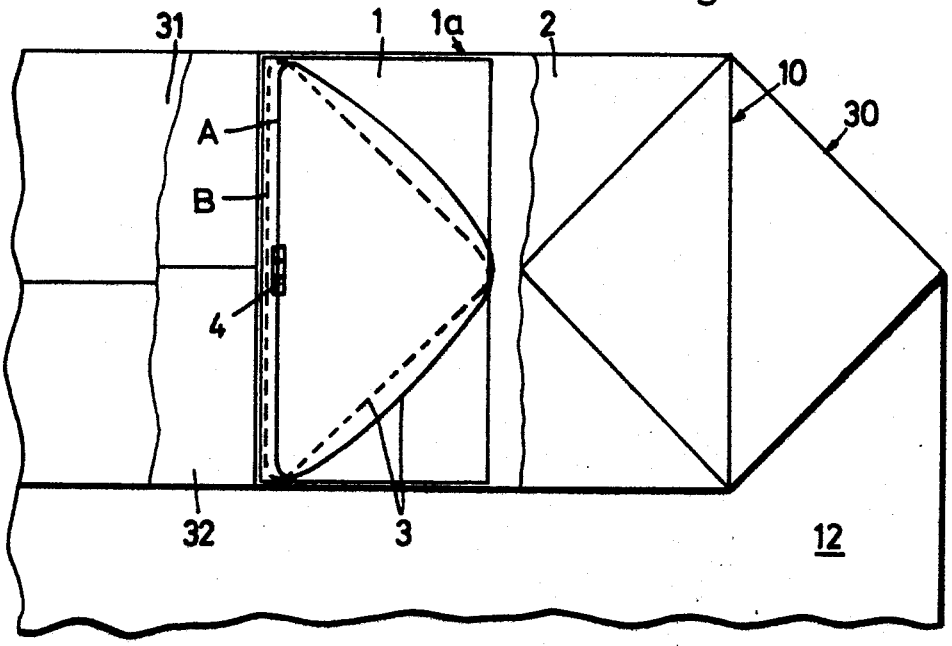
FIG. 4 is a plan view similar to FIG. 3 after the trapezoidal end flaps are folded over.

In FIG. 4 the edges of the folding flaps 31 32 are shown in dotted lines for clarity to show the filler valve 10 more distinctly. The valve bag 12 is now finished and may be stacked and stored ready for filling. Unintentional closure of the filler valve is excluded because the free end section A of the spring element 3 bears against the secured flaps 31, 32 and because at the same time the part 1*a* of the filler valve 10 bears against the part of the bag lying beneath it. Thus the tube of filler valve 10 is held flat with the spring element 3 stressed.

Figure 5:
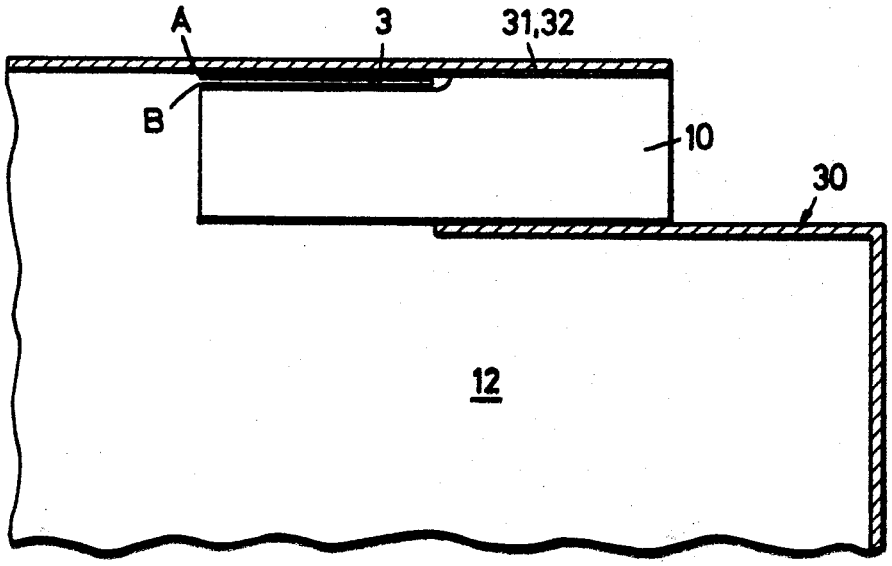
FIG. 5 is a cross section through the upper part of the valve bag, with the filler valve open.

For filling the valve bag 12 the filler valve 10 is opened manually at its inlet (right hand) end and then pushed over the filling nozzle of the filler mechanism (see FIG. 5). In this connection it is pointed out that the axis of the filler valve 10 in the filling position of the valve bag 12 in general runs vertically, and not horizontally as shown in FIG. 5. When the valve is opened the spring element 3 is still stressed, as shown in FIG. 5, with the free end section A bearing against the flaps 31, 32, and the filling nozzle (not shown) supporting the end section B of the spring element 3 against deflection.

Figure 6:
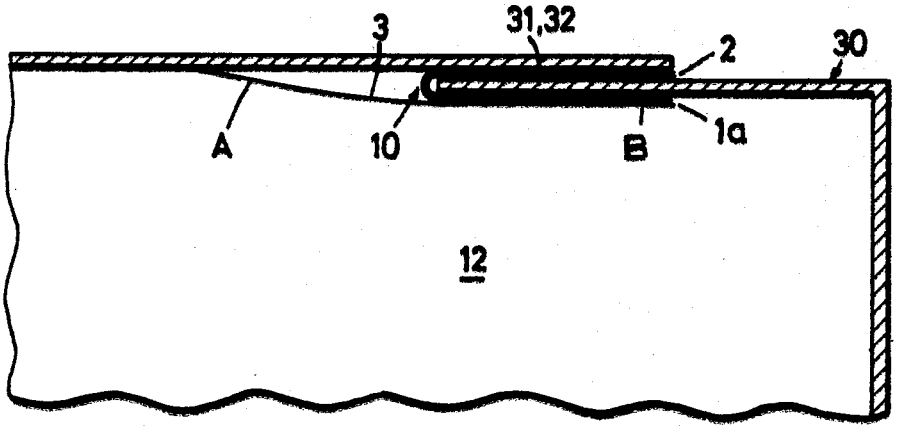
FIG. 6 is a section similar to FIG. 5, but showing the filler valve closed.

When the filling nozzle is removed from the valve the support for the end section B of the spring element 3 is removed, so that it swings over carrying with it the part 1*a* of the filler valve 10, into the position, as shown in FIG. 6, in which the spring element 3 is unstressed. As a result the tube of the filler valve gets folded over and squeezed off along its fold line, whereby the valve is closed. This movement is not impeded by the bulk material deposited in the valve bag 12 since, as with all valve bags, filling does not take place beyond the filler valve. The valve closing process is not prevented by the sidewalls of the bag because when the bag is filled, the distance between the sidewalls is greater than the width of the filler valve 10. The line of fold is also sufficiently well defined to shut off the valve bag tightly against ingress of moisture from the atmosphere. The state of closure is maintained by the spring element and is backed up by the pressure of the bulk material against it during conveyance of the filled bag.

Figure 7:
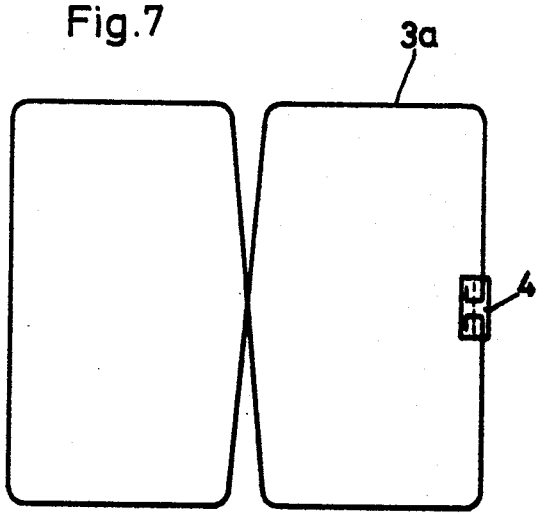
FIGS. 7 and 8 show different forms of a spring element suitable for use in the filler valve of FIG. 1.
Figure 8:
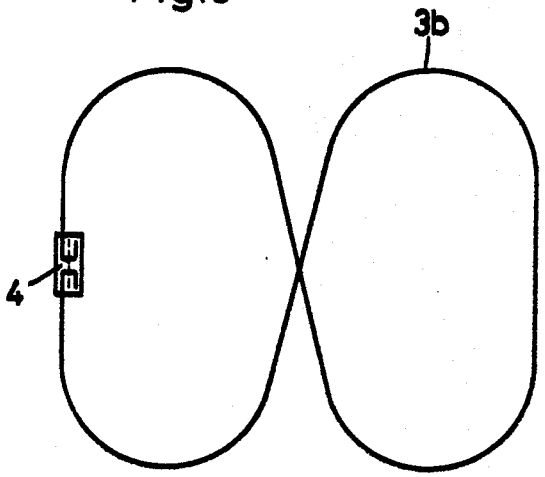

Instead of the above described spring element 3 spring elements 3*a*, 3*b*, as shown in FIGS. 7 and 8, respectively, could be employed. The spring elements are both of closed "8" configuration but their crossing portions intersect at angles between 0° and 15°. Furthermore Z-shaped or S-shaped spring elements are possible also since it is only important that when the element is folded over excessive bending stresses should not be present. With S- or Z-shaped spring elements a substantial portion of the element should lie on or in the region of the line of fold.

Instead of using a sheet metal connection piece 4 the free ends of the spring element wire could be fixed together by overlapping and gluing, or by welding. However, care should be taken to see that the free ends of the spring element cannot puncture the filler valve and the valve bag. Moreover, the operation of the filler valve is not dependent upon the spring element 3 consisting of spring steel wire because other springy materials could be used. Finally, it may be pointed out that also the spring element 3 does not have to be attached to the tube of the filler valve 10 with the adhesive tape 1. It is possible, for example, to enclose the end section B of the spring element between films and to weld them to the tube.

What is claimed is:

1. A valve bag for bulk material, comprising a tubular body with opposite ends, closure sections closing said opposite ends of the body, a filler valve secured to one of said closure sections, the filler valve including tube means extending through said one closure section and having inner and outer end parts, a fold line separating the inner and outer end parts and said outer end part being fastened to the one closure section, and spring means attached to said inner end part of said tube means and acting against said one closure section for folding over said inner part of the tube means about said fold line, thereby to pinch off the tube means and close the filler valve automatically.

2. A valve bag according to claim 1, wherein the spring means comprises a spring element having a first end section attached to the tube means, a second end section which bears against the one closure section, and a pivotable interconnection between the first and second end sections and in the region of said fold line, the first end section being stressed to overlie the second end section when the tube means is unfolded over and being pivotably urged about the interconnection to lie adjacent to the second end section when the tube means is folded over.

3. A valve bag according to claim 2, wherein said first end section of the spring element is attached to said tube means by a piece of film material secured by an adhesive or welded to said inner end part of the tube means.

4. A valve bag according to claim 2, in which the second end section is unattached to the one closure section.

5. A valve bag according to claim 2, in which the valve bag when empty is folded to hold the first end section of the spring means stressed to overlie the second end section and thereby to hold the tube means unfolded over.

6. A valve bag according to claim 2, wherein the spring element is produced from spring wire.

7. A valve bag according to claim 6, wherein said spring element is "Z"-shaped with two oppositely facing angled hook portions comprising the respective first and second end sections.

8. A valve bag according to claim 6, wherein said spring element, when unstressed, has a closed "8" configuration with two loops comprising the respective first and second end sections and intersecting portions comprising the interconnection.

9. A valve bag according to claim 8, wherein the intersecting portions cross each other in the region of said fold line.

10. A valve bag according to claim 9, wherein said intersecting portions intersect at an angle of approximately 90°.

11. A valve bag according to claim 9, wherein said spring element portions intersect at an angle between 0° and 15°.

12. A valve bag according to claim 9, in which the one closure end surrounds the tube means and the body is folded along its sides near the one closure end and transverse to the fold line of the tube means to flatten the body and the one closure end when the valve bag is empty, thereby maintaining the first end section so it overlies the second end section of the spring element.

13. A valve bag according to claim 1, in which the one closure end surrounds the tube means and the sides of the one closure end transverse to the fold line of the tube means are folded to flatten the one closure end when the valve bag is empty, thereby maintaining the tube means unfolded over.

14. A valve bag for bulk material, comprising a tubular body with opposite ends, closure sections closing the opposite ends of the body such that the tubular body and the closure sections lie flat when the tubular body is empty, a filler valve secured in one of said closure sections and extending through the one closure section, the filler valve comprising a tube extending through one closure section and having an inner end part, an outer end part and a fold line separating the inner and outer end parts, a spring attached to the inner end part of the tube, being in stress condition when the inner end part is unfolded, and acting against the one closure section for folding over the inner end part of the tube about the fold line to pinch off the tube and close the filler valve, the body being folded near the closure sections and transverse to the fold line of the tube to flatten the body and the closure sections when the valve bag is empty, the spring being held in stressed condition by the one closure section and the body when the one closure section and the body lie flat to prevent the spring from folding over the inner end part.

15. A valve bag according to claim 14, wherein the spring means comprises a spring element having a first end section attached to the tube means, a second end section which bears against the one closure section, and a pivotable interconnection between the first and second end sections and in the region of said fold line, the first end section being stressed to overlie the second end section when the tube means is unfolded over and being pivotably urged about the interconnection to lie adjacent to the second end section when the tube means is folded over.

* * * * *

UNITED STATES PATENT AND TRADEMARK OFFICE

CERTIFICATE OF CORRECTION

PATENT NO. : 4,111,354

DATED : September 5, 1978

INVENTOR(S) : Dieter Brunker

It is certified that error appears in the above-identified patent and that said Letters Patent are hereby corrected as shown below:

Col. 4, lines 48 and 49, Claim 3, "by an adhesive or welded" should be deleted.

Col. 5, line 8, Claim 11, "spring element" should be changed to --intersecting--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*